US008899107B2

(12) United States Patent
Abad et al.

(10) Patent No.: US 8,899,107 B2
(45) Date of Patent: Dec. 2, 2014

(54) DOWNHOLE DETERMINATION OF ASPHALTENE CONTENT

(75) Inventors: Carlos Abad, Richmond, TX (US); Anthony R. H. Goodwin, Sugar Land, TX (US); Bruno Drochon, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 494 days.

(21) Appl. No.: 12/401,813

(22) Filed: Mar. 11, 2009

(65) Prior Publication Data

US 2010/0229623 A1 Sep. 16, 2010

(51) Int. Cl.
*E21B 43/16* (2006.01)
*E21B 49/08* (2006.01)

(52) U.S. Cl.
CPC *E21B 49/08* (2013.01); *E21B 43/16* (2013.01)
USPC ..... 73/152.55

(58) Field of Classification Search
CPC ..... E21B 43/16
USPC ..... 73/152.54, 152.55
See application file for complete search history.

(56) References Cited

U.S. PATENT DOCUMENTS

| | | | | |
|---|---|---|---|---|
| 4,739,654 | A | 4/1988 | Pilkington et al. | |
| 5,693,122 | A * | 12/1997 | Berndt | 96/6 |
| 6,176,323 | B1 * | 1/2001 | Weirich et al. | 175/40 |
| 6,287,822 | B1 * | 9/2001 | Gjerde et al. | 435/91.2 |
| 6,773,921 | B1 * | 8/2004 | Schabron et al. | 436/29 |
| 7,114,562 | B2 | 10/2006 | Fisseler et al. | |
| 2006/0011547 | A1 | 1/2006 | Bell | |
| 2007/0119244 | A1 * | 5/2007 | Goodwin et al. | 73/152.28 |
| 2010/0031754 | A1 * | 2/2010 | Atkinson | 73/861.04 |

FOREIGN PATENT DOCUMENTS

WO 20080064402 6/2008

* cited by examiner

*Primary Examiner* — Paul Hyun
(74) *Attorney, Agent, or Firm* — Cathy Hewitt; Kenneth L. Kincaid

(57) ABSTRACT

A system and method for determining the asphaltene content of a downhole oil sample are provided. In one example, the method includes obtaining a hydrocarbon sample from a hydrocarbon formation of a reservoir at a given depth using a downhole tool. A liquid phase of the hydrocarbon sample is isolated within the downhole tool and the liquid phase is subjected to downhole analysis within the downhole tool to create a chromatography sample. The downhole analysis is based at least partially on size exclusion chromatography. A first property of the chromatography sample is measured to obtain a measured value, and a second property of the chromatography sample is estimated based on the measured value and known calibration curves.

20 Claims, 10 Drawing Sheets

DOWNHOLE DETERMINATION OF ASPHALTENE CONTENT

BACKGROUND

Reservoir fluid analysis is a key factor for understanding and optimizing reservoir management. In most hydrocarbon reservoirs, fluid composition varies vertically and laterally in a formation. Fluids may exhibit gradual changes in composition caused by gravity or biodegradation, or they may exhibit more abrupt changes due to structural or stratigraphic compartmentalization. Traditionally, fluid information is obtained by capturing samples, either at downhole or surface conditions, and then measuring various properties of the samples in a surface laboratory. In recent years, downhole fluid analysis (DFA) techniques, such as those using a Modular Dynamics Tester (MDT) tool, have been used to provide downhole fluid property information. However, the extreme conditions of the downhole environment limit the sophistication of DFA measurement tools, and therefore limit the measurement of fluid properties to a small subset of those provided by a conventional surface laboratory analysis.

SUMMARY

The proposed measurement provides complementary information to that already provided by the MDT DFA with OFA and CGA, etc. For example, the provision of the average molar mass of the oil that, when combined with the C1 to C6 fraction and CO2, provides overall more details of the chemical composition for reservoir modeling by adjustment of the equation of state parameters used.

In one embodiment, a downhole tool for the downhole analysis of liquids is provided. The downhole tool includes a housing, a solvent reservoir positioned within the housing, a liquid sample admission port, a dilution module, and a size exclusion module. The dilution module is positioned within the housing and includes a mixing chamber configured to receive solvent from the solvent reservoir and a hydrocarbon liquid sample from the liquid sample admission port. The size exclusion separation module is positioned within the housing and coupled to the dilution module. The size exclusion separation module includes at least one size exclusion chromatography column configured to receive solvent and at least a portion of the hydrocarbon liquid sample from the injection module.

In another embodiment, a method comprises obtaining a hydrocarbon sample from a hydrocarbon formation of a reservoir at a given depth using a downhole tool and isolating a liquid phase of the hydrocarbon sample within the downhole tool. The liquid phase of the hydrocarbon sample is subjected to downhole analysis within the downhole tool to create a chromatography sample, wherein the downhole analysis is based at least partially on size exclusion chromatography. A first property of the chromatography sample is measured to obtain a measured value, and a second property of the chromatography sample is estimated based on the measured value and known calibration curves.

In yet another embodiment, a method for use in a downhole tool comprises transferring a known amount of a solvent and a known amount of a hydrocarbon liquid sample into a dilution module in the downhole tool and waiting for the hydrocarbon liquid sample to dissolve into the solvent in the dilution module to form a chromatography sample. A known amount of the sample is drawn into an injection loop in the downhole tool. The chromatography sample is injected from the injection loop into a stream of the solvent flowing into a column set in the downhole tool. A fluid exiting the column set is flowed to a detector in the downhole tool, wherein the fluid contains solvent and at least a portion of the chromatography sample. An output of the detector is recorded as a chromatogram and a temperature of the detector is recorded. The recorded output is analyzed.

BRIEF DESCRIPTION OF THE DRAWINGS

For a more complete understanding, reference is now made to the following description taken in conjunction with the accompanying Drawings in which.

DETAILED DESCRIPTION

The present disclosure relates to various views and embodiments of a system and method for downhole size exclusion chromatography. The figures are not necessarily drawn to scale, and in some instances the drawings have been exaggerated and/or simplified in places for illustrative purposes only. One of ordinary skill in the art will appreciate the many possible applications and variations based on the described embodiments.

As is known, the millions of different organic chemical compounds that may be present in hydrocarbon samples have several chemical and physical characteristics that can be used to detect and classify the various compounds. Various techniques can be used to separate the hydrocarbons into more manageable fractions ranging from those composed of a single chemical to those composed of multiple compounds formed from a few similar compounds, a few hundred compounds, or even several thousand compounds. Each of the techniques used contributes to partial elucidation of these chemicals and a better understanding of the reservoir fluids and/or the end use properties of the hydrocarbons. Typical separation techniques include simple phase separation (i.e., gas versus liquid), gas chromatography, solution precipitation, on column chromatography, high performance liquid chromatography (HPLC), and others. Once separated, other techniques are used to identify and quantify the amount of separated compounds such as flame ionization, thermal conductivity, dielectric constant, mass spectrometry, refractive index, spectroscopy (including ultraviolet (UV), near infrared (NIR), and infrared (IR)), atomic absorption, and Inductively Coupled Plasma (ICP) Atomic Emission Spectrometry (AES). Such techniques may also be used to evaluate other properties such as density or viscosity.

The following disclosure describes embodiments illustrating the use of downhole size exclusion liquid chromatography as a means to roughly separate hydrocarbon molecules of a hydrocarbon formation sample according primarily to their size. The disclosure also describes embodiments directed to estimating the average molecular weight of mobile hydrocarbon samples (mainly black and asphaltenic oils), estimating the American Petroleum Institute (API) density and thus the massic or amount of substance density, and estimating the asphaltene content of the hydrocarbons by combining multiple zone downhole sampling and analysis results. Portions of the analysis can also be done at the surface and can be combined with calibration procedures using more elaborate sample analysis such as densimetry or SARA (saturates, aromatics, resins, asphaltenes) analysis of selected samples brought to surface.

Figure 1A:
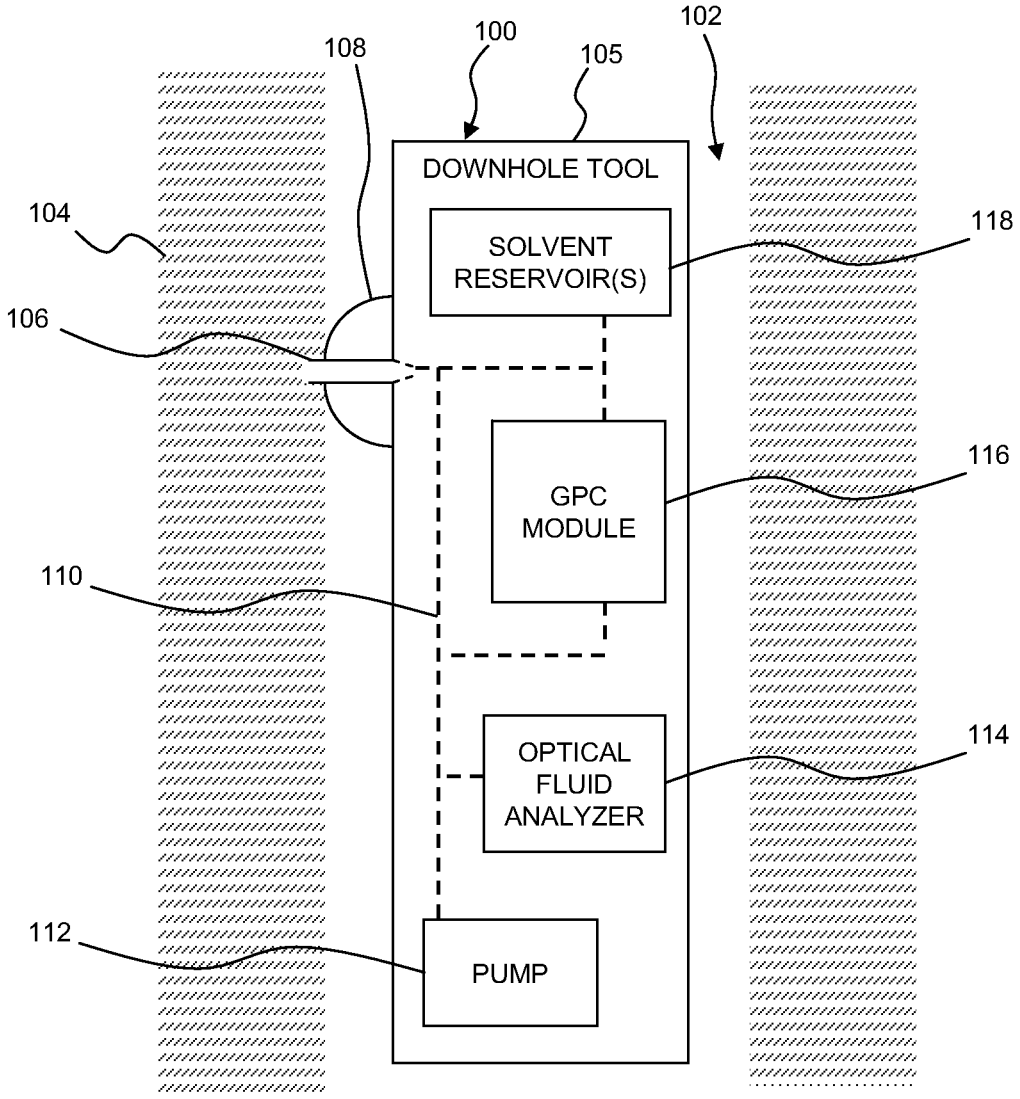
FIG. 1A is a diagram of one embodiment of a downhole tool.
Figure 1B:
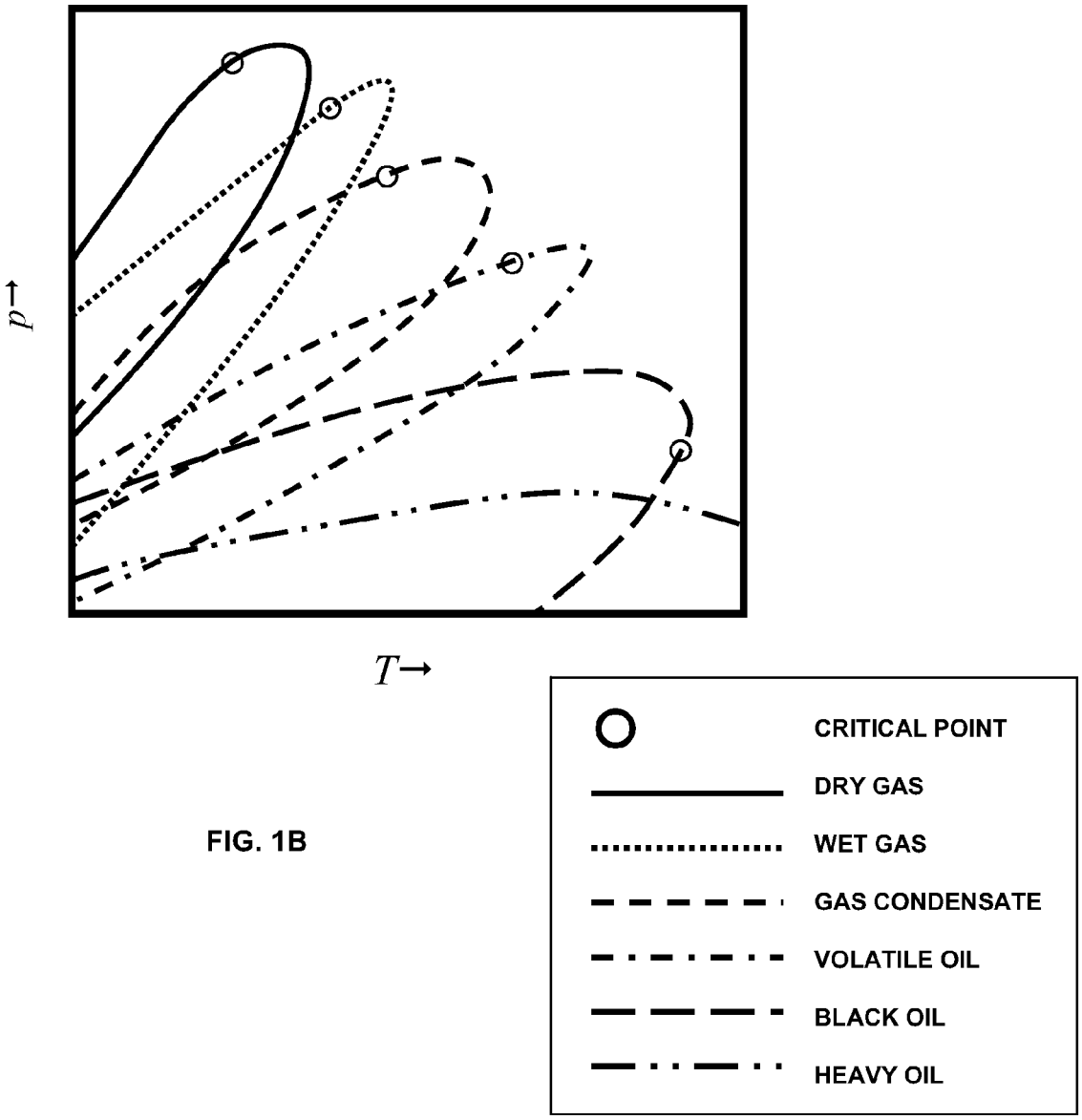
FIG. 1B is a diagram of a (p, T) section illustrating bubble curves, dew curves, and critical points for reservoir fluids.

Referring to FIG. 1A, one embodiment of a downhole tool 100 is illustrated. The tool 100 may be used in a borehole 102 formed in a geological formation 104, and may be conveyed by wire-line, drill-pipe, tubing, or any other means (not shown) used in the industry. With additional reference to FIG. 1B, the phase behavior of the categories of dry gas, wet gas, gas condensate, volatile oil, black oil, and heavy oil that may be present in the formation 104 are illustrated. In FIG. 1B, the classification is with regard to the topology of the critical and three-phase curves under the nomenclature of Bolz et al. as described in A. Bolz, U. K. Deiters, C. J. Peters and T. W. deLoos, Pure Appl. Chem. 70 (1998) 2233-2257, and are considered to exhibit only class $I^p$ phase behavior. Except for so-called black and heavy oils, the bubble curve commences at temperatures immediately below critical while the dew curve commences at temperatures immediately above critical and, after increasing, reaches a maximum and then decreases, albeit at pressures lower than the corresponding bubble pressure at the same temperature. For black (conventional) oil, the dew temperatures occur at temperatures immediately below critical.

For dry gas, also known as conventional gas, the production (p, T) pathway does not enter the two-phase region while with wet gas, for which the reservoir temperature is above the cricondentherm, the production pathway intersects the dew curve at a temperature below that of the reservoir. A retrograde gas condensate is characterized by reservoir temperature above the critical temperature $T_c$, but below the temperature of the cricondentherm. During pressure depletion at reservoir temperature, liquids form within the formation itself by retrograde condensation. The relative volume of liquid in the formation and its impact on production is a function of the difference between the system and critical temperatures and on the reservoir rock properties. For a retrograde gas system, liquid will be present in production tubing and surface facilities as the production (p, T) pathway enters the two-phase region. Volatile oil (also a conventional fluid) behavior is similar to that of retrograde gas condensates because T is less than $T_c$, but compared to black oils at a reservoir temperature close to $T_c$. The major difference between volatile oils and retrograde condensates is that during production, and thus reservoir resource depletion, a gas phase evolves in the formation at pressure less than the bubble pressure. Small changes in composition that might arise through the method chosen to sample the fluid can lead to the incorrect assignment of a gas condensate for a volatile oil or vice versa. Under these circumstances, production engineers could design a facility inappropriate for the fluid to be produced. The reservoir temperature of black oil is far removed from $T_c$.

The relative volume of gas evolved when p is reduced to 0.1 MPa at T=288 K (so called stock tank conditions) from fluid is known as the Gas-Oil Ratio (GOR). Quantitative analysis of the normally gaseous components is required to evaluate the (liquid+gas) phase boundary with semi-empirical equations of state such as those developed from van der Waals equation. The needed data can be obtained in a laboratory or estimated down-hole with, for example, an Optical Fluid Analyzer manufactured by Schlumberger Limited. For black oil, the GOR is small compared to other fluid types and results in relatively large volumes of liquid at separator and ambient conditions. Black oil is also known as conventional oil and forms the majority of the fluids that have been produced and used to date. For so called conventional and recoverable Newtonian hydrocarbon liquids, the density is often within the range 700 to 900 $kg \cdot m^{-3}$ while the viscosity is between 0.5 and 100 mPa·s and it is the gas-to-liquid phase behavior that dominates the characteristics of volatile oil and gas condensates. Indeed, the phase behavior of gas condensates is determined by knowledge of the higher molar mass normally liquid components, while that of volatile and conventional oils is determined by the concentration of normally gaseous constituents.

The (solid+liquid) phase behavior of petroleum fluids depends on the distribution of the higher $\{M(C_{25}H_{52}) \approx 0.350\ kg \cdot mol^{-1}\}$ molar mass hydrocarbons, such as asphaltenes, paraffins, aromatics, and resins in the fluids. Deposits of waxes (and hydrates) are predominantly formed by a decrease in temperature, whereas deposits of asphaltenes are formed by a pressure decrease. The (solid+liquid) phase diagram, which includes so called wax and asphaltenes, can dominate the substance's properties and this phase border can be estimated with a determination of the distribution of the higher $\{M(C_{25}H_{52}) \approx 0.350\ kg \cdot mol^{-1}\}$ molar mass hydrocarbons. This approach also permits the estimation of all thermophysical properties for these hydrocarbons that are important for all stages of hydrocarbon resource from exploitation for appraisal and during production for reservoir management and optimization.

Heavy oil can have viscosity of up to about 10 kcP, while bitumen has a lower gas content and often higher density than heavy oil while the viscosity is greater than 10 kcP. The 10 kcP divide is a definition adopted by the United Nations and is supported by experimental evidence. Thus the viscosity and, to a lesser extent, the density are important for heavy oil and bitumen. The chemical composition is also important as it determines the phase behavior that can be estimated from an equation of state (EoS). The EoS predictions can then be used in a reservoir simulator for porous media, and fluids and flow in tubulars. In such a simulator, the reservoir and fluid are segmented into blocks. The simulator can be used to estimate an optimal production strategy. The EoS is semi-empirical and measurements of density, viscosity, phase border, and chemical composition are used to adjust parameters within a simulation model.

However, in a reservoir simulator there may be on the order of $10^6$ calls to an EoS package that calculates the thermophysical properties of the fluid. Accordingly, the methods chosen to estimate these properties are selected so as to not contribute significantly to the time required to perform the simulation. This requirement typically precludes, at least for routine work, the use of intensive calculation methods that are based on detailed knowledge of the chemical composition. Because of the desire for relatively simple correlations, the chemical composition is often truncated into groups and typically reduced to less than ten parameters with frequent utilization of both empirical and semi-empirical methods for a particular process. The ten parameters represent the so-called light and heavy ends. The light ($C_1$ to $C_6$) components can be estimated using the previously mentioned Optical Fluid Analyzer. The following disclosure describes the use of downhole Gel Permeation Chromatography (GPC) to obtain the higher $\{M(C_{25}H_{52})\approx 0.350\ kg\cdot mol^{-1}\}$ molar mass hydrocarbon distribution. Accordingly, the tool 100 may be configured to perform downhole GPC to provide in real-time the data needed to facilitate the estimation of the reservoir's hydrocarbon behavior. The application of GPC may involve additional measurements such as viscosity, but these may be readily available using functionality provided by the tool 100.

Referring again specifically to FIG. 1A, in the present example, the tool 100 includes a housing 105 that contains a sampling probe 106 with a seal (e.g., packer) 108 that is used to acquire an aliquot of hydrocarbon from the formation 104. The hydrocarbon may be mobilized by a method such as heating and/or diluent injection. As such hydrocarbon mobilization is well known in the art, the various components needed for such mobilization are not illustrated in the tool 100.

The mobilized hydrocarbon enters a flow-line 110 that may be used to transport the hydrocarbon to any location within the tool 100 by a pump 112. One location to which the hydrocarbon may be transported is an optical fluid analyzer 114 that may provide an estimate of the chemical composition from $C_1$ to $C_6$ (as described above). Another location to which the hydrocarbon may be transported for analysis is a size exclusion separation (e.g., Gel Permeation Chromatography (GPC)) module 116. Solvents required for the analysis are contained in one or more solvent reservoirs 118, which may each contain different solvents (also known as diluents or eluents). The solvents may be used with GPC module 116 to determine the molar mass of the components as will be described below. In one embodiment, the analysis may use hydrocarbon viscosity measurements that may be obtained by a viscometer in the optical fluid analyzer 114 or elsewhere in the tool 100.

Figure 2:
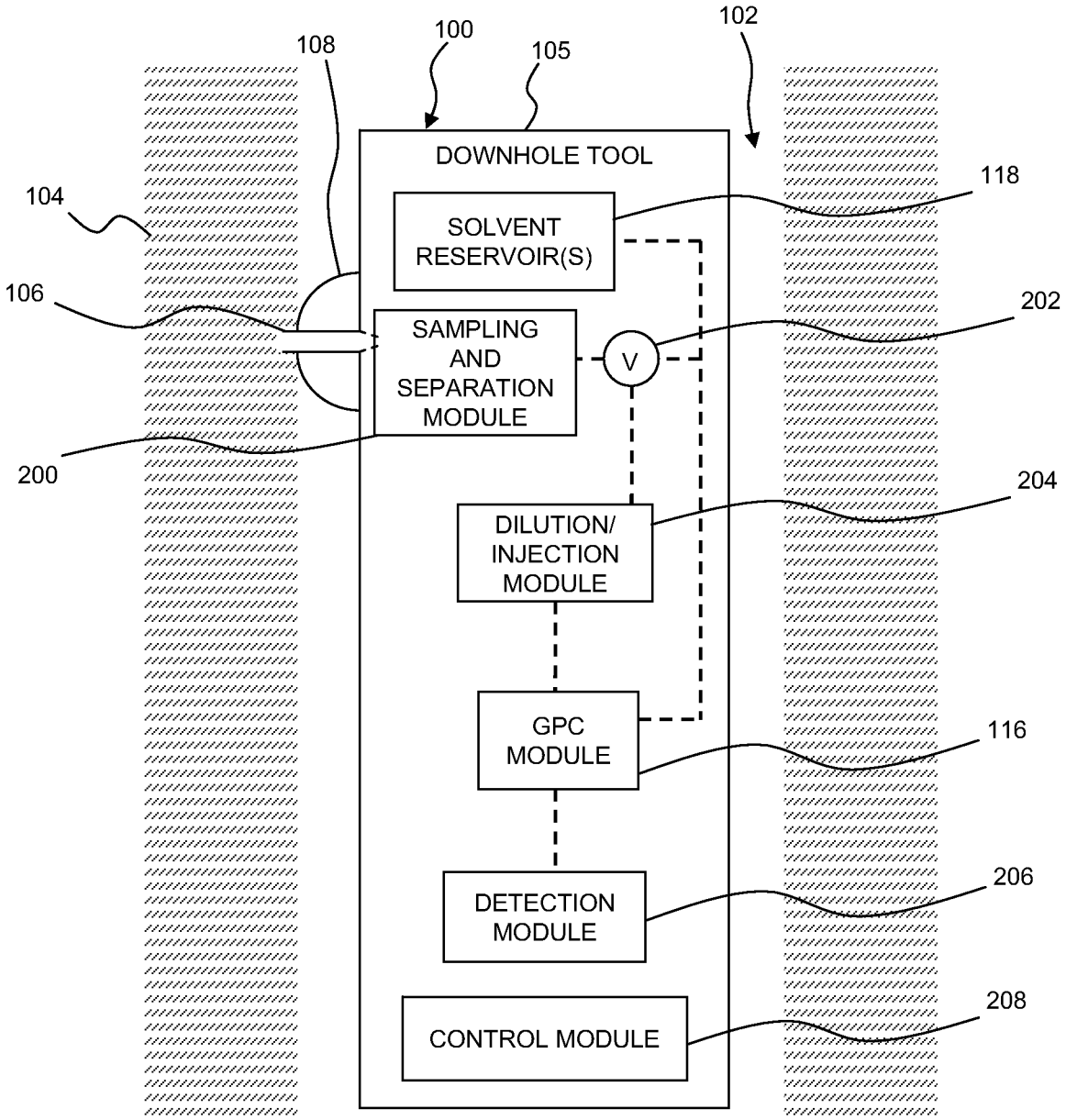
FIG. 2 is a diagram of a more detailed embodiment of the downhole tool of FIG. 1A.

Referring to FIG. 2, another embodiment of the tool 100 of FIG. 1A is illustrated. In the present example, the pump 112 and optical fluid analyzer 114 have been omitted for purposes of clarity. A sampling and separation module 200 is coupled to the sampling probe 106. The sampling and separation module 200 receives a sample (not shown) from the formation 104 and separates the sample into various portions, such as into gas/condensate, black oil, and water portions. The sampling and separation module 200 passes the sample into one or more sampling valves 202, which are coupled to the solvent reservoir(s) 118, a dilution/injection module 204, and the GPC module 116. The sampling valves 202, which may be part of the dilution/injection module 204 in some embodiments, may be used to regulate the flow rate and/or flow path of various substances, including the sample and solvent.

The dilution/injection module 204 may include a dilution portion used to mix the sample with solvent in order to dilute the sample for size exclusion by the GPC module 116 and an injection portion having injection valves and an injection loop. A detection module 206 may receive the sample from the GPC module 116 and perform various measurements on the sample. In some embodiments, the detection module 206 may be part of the GPC module 116. A control module 208 may be coupled via signal paths (not shown) to various modules of the tool 100, including the sampling and separation module 200, valves 202, dilution/injection module 204, GPC module 116, and detection module 206. The signal paths may be wired and/or wireless, depending on the particular configuration of the tool 100. The control module 208 may also include functionality for communicating with surface equipment.

Figure 3A:
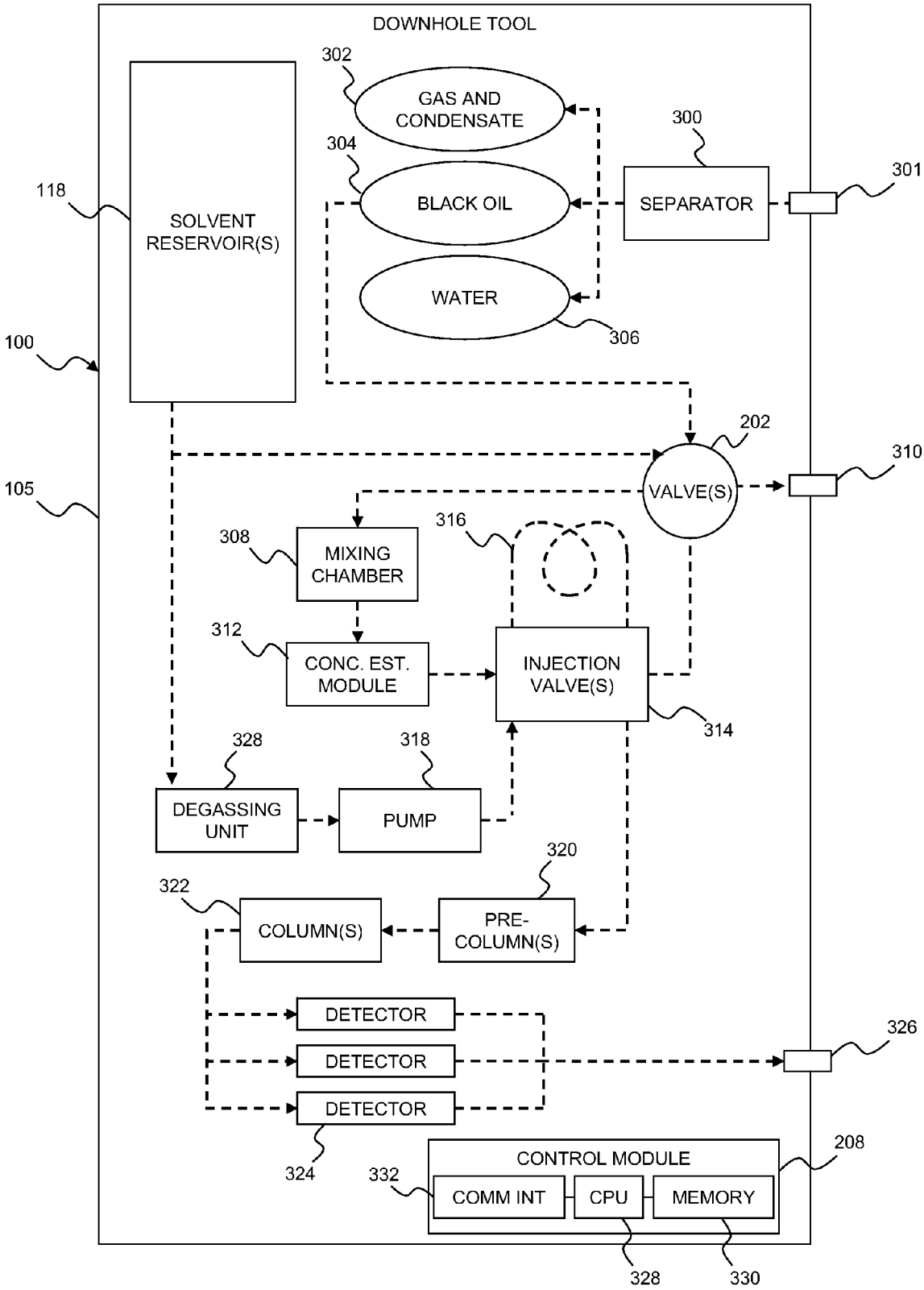
FIG. 3A is a diagram of a more detailed embodiment of the downhole tool of FIG. 2.

Referring to FIG. 3A, a more detailed embodiment of the tool 100 of FIG. 2 is illustrated. It is understood that the tool 100 may have a temperature that is equivalent to the temperature of the wellbore or portions of the tool may be heated or cooled. The sampling and separation module 200 (FIG. 2) includes a separator 300 coupled to a sampling port 301. The sampling port 301 may be coupled to the sampling probe 106 or may include the sampling probe 106. The separator 300 separates a hydrocarbon sample (not shown) received via the sampling port 301 into a gas/condensate portion 302, a black oil portion 304, and a water portion 306. The solvent reservoir 118 is used to store the solvent used by other modules of the tool 100.

The dilution/injection module 204 (FIG. 2) includes one or more sampling valves 202, a mixing chamber 308, and a disposal port 310. In some embodiments, the dilution/injection module 204 may also include a pre-injection concentration estimation module 312. In the present example, the dilution/injection module 204 also includes an injection module having one or more injection valves 314, which may be shared with other modules of the tool 100. The injection valves 314 are coupled to an injection loop 316 that may also be shared. It is understood that the dilution and injection modules may be separate from one another, or another module may contain the injection valves 314 and/or injection loop 316, and the dilution module 204 may share these components.

The GPC module 116 (FIG. 2) includes a high pressure flow control pump 318 and a size exclusion separation portion formed by a column set containing columns 322 (and precolumns 320 in some embodiments). The pump 318 may be similar or identical to the pump 112. In some embodiments, the GPC module 116 may include a degassing unit 328.

The detection module 206 (FIG. 2), which may be part of the GPC module 116 in some embodiments, is coupled to an outlet of the column set and includes one or more detectors 324 that may be connected in series or in parallel (as shown). The type of detectors 324 may vary depending on the configuration of the tool 100, but example detectors include spectrophotometers capable of measuring UV absorbance and UV fluorescence and static light scattering detectors. An outlet of the detectors 324 may be coupled to a disposal port 326 for the disposal of the sample/solvent mix passing through the detectors.

The control module 208 is capable of bidirectional communication with various modules and module components, depending on the particular configuration of the tool 100. For example, the control module 208 may communicate with modules, which in turn control their own components, or the control module 208 may control the components directly. In the present example, the control module 208 may communicate with the separator 300, the sampling valves 202, the mixing chamber 308, the pre-injection concentration estimation module 312, the injection valves 314, the pump 318, the degassing unit 328, and the detectors 324. The control module 208 may include a central processing unit (CPU) or other processor 328 coupled to a memory 330 in which are stored instructions for the acquisition and storage of the required parameters, as well as for other functions. The CPU 328 may also be coupled to a communications interface 332 for wired and/or wireless communications. It is understood that the CPU 328, memory 330, and communications interface 332 may be combined into a single device or may be distributed in many different ways. In some embodiments, means for powering the tool 100 and transferring the information to the surface may also be incorporated in the control module 208.

In one example of the operation of the tool 100 of FIG. 3A, the separator 300 separates a sample received via the sampling port 301 into the gas/condensate portion 302, the black oil portion 304, and the water portion 306. This might be achieved with gravity separators, a centrifuge, and/or other methods. The black oil portion 304 is passed on to the sampling valves 202. In some embodiments, the gas/condensate portion 302, black oil portion 304, and water portion 306 may all be passed to the sampling valves 202, and the gas/condensate portion 302 and water portion 306 may be vented via the disposal port 310 (which may also include a vacuum pump). Solution from the solvent reservoir 104 may also be passed into the sampling valves 202. Both the black oil portion 304 and solution may be mixed in the mixing chamber 308 to provide a desired sample for later size exclusion separation. The mixed sample may be passed through the pre-injection concentration estimation module 312 (if present) and into injection valves 314. In some embodiments, the mixed sample may be returned to the mixing chamber 308 based on the results of the pre-injection concentration estimation module 312.

Solution from the solution reservoir 118 is passed through degassing unit 328 (if present) and pump 318. The mixed sample is drawn into the injection loop 316 and the pump 318 pumps the mixed sample through the injection valves 314 and into the column set. The mixed sample enters the precolumns 320 and columns 322 from the injection valves 314 for size exclusion. Following the size exclusion process, detectors 324 perform detection functions and the mixed sample may be vented via disposal port 326. This process may be entirely or partly controlled by control module 208.

Figure 3B:
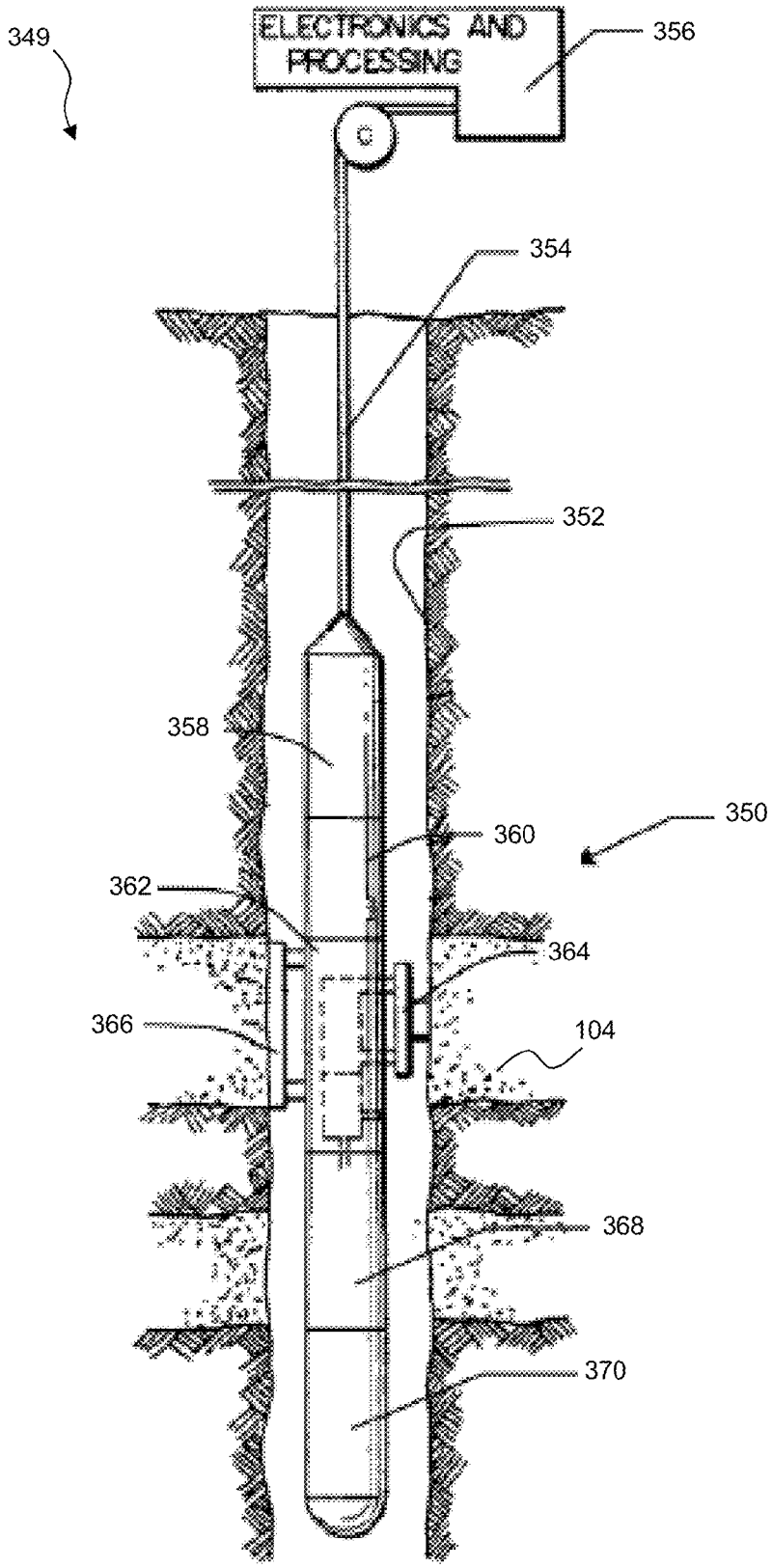
FIG. 3B is a diagram of one embodiment of an environment within which the downhole tool of FIG. 1 may be used.

Referring to FIG. 3B, one embodiment of an environment 349 with a wireline tool 350 is illustrated in which aspects of the present disclosure may be implemented. The wireline tool 350 may be similar or identical to the downhole tool 100 of FIG. 1. The wireline tool 350 is suspended in a wellbore 352 in the formation 104 (FIG. 1) from the lower end of a multi-conductor cable 354 that is spooled on a winch (not shown) at the Earth's surface. At the surface, the cable 354 is communicatively coupled to an electronics and processing system 356. The wireline tool 350 includes an elongated body 358 that includes a formation tester 362 having a selectively extendable probe assembly 364 and a selectively extendable tool anchoring member 366 that are arranged on opposite sides of the elongated body 358. Additional components 360 (e.g., components described above with respect to FIGS. 1A, 2, and 3A) may also be included in the tool 350.

One or more aspects of the probe assembly 364 may be substantially similar to those described above in reference to the embodiments shown in FIGS. 1A, 2, and 3A. For example, the extendable probe assembly 364 is configured to selectively seal off or isolate selected portions of the wall of the wellbore 352 to fluidly couple to the adjacent formation 104 and/or to draw fluid samples from the formation 104. The formation fluid may be separated, diluted, analyzed, and expelled through a port (not shown) as described herein and/or it may be sent to one or more fluid collecting chambers 368 and 370. In the illustrated example, the electronics and processing system 356 and/or a downhole control system (e.g., the control module 208 of FIG. 2) are configured to control the extendable probe assembly 364 and/or the drawing of a fluid sample from the formation 104. Dual packers may also be used to effect a seal with the formation and extract by use of draw-down pressure an aliquot of sample from the formation.

Figure 3C:
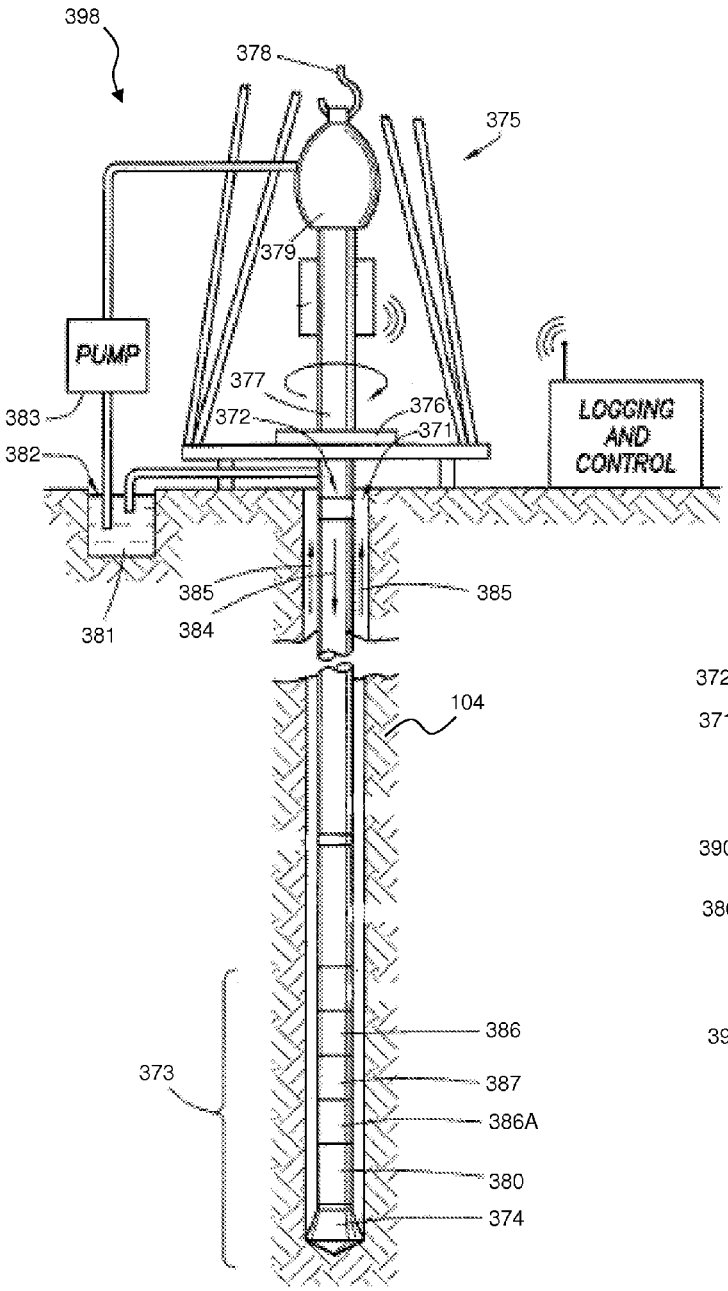
FIG. 3C is a diagram of another embodiment of an environment within which the downhole tool of FIG. 1 may be used.

Referring to FIG. 3C, one embodiment of an environment 398 illustrates a wellsite system in which aspects of the present disclosure may be implemented. The wellsite can be onshore or offshore. In this exemplary system, a borehole 371 is formed in subsurface formations (e.g., the formation 104 of FIG. 1) by rotary drilling in a manner that is well known. Embodiments of the disclosure can also use directional drilling.

A drill string 372 is suspended within the borehole 371 and has a bottom hole assembly 373 which includes a drill bit 374 at its lower end. The surface system includes platform and derrick assembly 375 positioned over the borehole 371, the assembly 375 including a rotary table 376, kelly 377, hook 378 and rotary swivel 379. The drill string 372 is rotated by the rotary table 376, energized by means not shown, which engages the kelly 377 at the upper end of the drill string. The drill string 372 is suspended from the hook 378, attached to a traveling block (also not shown), through the kelly 377 and the rotary swivel 379 which permits rotation of the drill string relative to the hook. As is well known, a top drive system could alternatively be used.

In the present example, the surface system further includes drilling fluid or mud 381 stored in a pit 382 formed at the well site. A pump 383 delivers the drilling fluid 381 to the interior of the drill string 372 via a port in the swivel 379, causing the drilling fluid to flow downwardly through the drill string 372 as indicated by the directional arrow 384. The drilling fluid 381 exits the drill string 372 via ports in the drill bit 374, and then circulates upwardly through the annulus region between the outside of the drill string and the wall of the borehole 371, as indicated by the directional arrows 385. In this well known manner, the drilling fluid 381 lubricates the drill bit 374 and carries formation cuttings up to the surface as it is returned to the pit 382 for recirculation.

The bottom hole assembly 373 of the illustrated embodiment includes a logging-while-drilling (LWD) module 386, a measuring-while-drilling (MWD) module 387, a roto-steerable system and motor 380, and drill bit 374.

The LWD module 386 is housed in a special type of drill collar, as is known in the art, and can contain one or a plurality of known types of logging tools. It is also understood that more than one LWD and/or MWD module can be employed, e.g., as represented by LWD tool suite 386A. (References, throughout, to a module at the position of 386 can alternatively mean a module at the position of 386A as well.) The LWD module 386 (which may be similar or identical to the tool 100 or may contain components of the tool 100) may include capabilities for measuring, processing, and storing information, as well as for communicating with the surface equipment. In the present embodiment, the LWD module 386 includes a fluid sampling device, such as that described with respect to FIGS. 1A, 2, and 3A.

The MWD module 387 is also housed in a special type of drill collar, as is known in the art, and can contain one or more devices for measuring characteristics of the drill string 372 and drill bit 374. The MWD module 387 further includes an apparatus (not shown) for generating electrical power to the downhole system. This may typically include a mud turbine generator powered by the flow of the drilling fluid, it being understood that other power and/or battery systems may be employed. In the present embodiment, the MWD module 387 may include one or more of the following types of measuring devices: a weight-on-bit measuring device, a torque measuring device, a vibration measuring device, a shock measuring device, a stick slip measuring device, a direction measuring device, and an inclination measuring device.

Figure 3D:
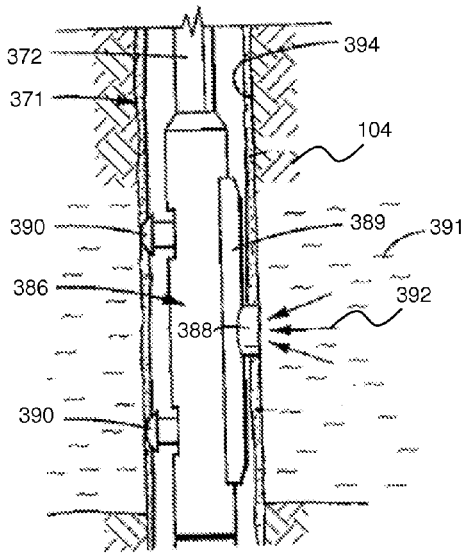
FIG. 3D is a diagram of an embodiment of a downhole tool within the environment of FIG. 3C.

FIG. 3D is a simplified diagram of a sampling-while-drilling logging device of a type described in U.S. Pat. No. 7,114,562, incorporated herein by reference, utilized as the LWD module 386 or part of the LWD tool suite 386A. The LWD module 386 is provided with a probe 388 (which may be similar or identical to the probe 106 of FIG. 1) for establishing fluid communication with the formation 104 and drawing fluid 391 into the module, as indicated by the arrows 392. The probe 388 may be positioned in a stabilizer blade 389 of the LWD module 386 and extended therefrom to engage a wall 394 of the borehole 371. The stabilizer blade 389 may include one or more blades that are in contact with the borehole wall 394. Fluid 391 drawn into the LWD module 386 using the probe 388 may be measured to determine, for example, pretest and/or pressure parameters. The LWD module 386 may also be used to obtain, filter, and measure various characteristics of the fluid 391 using, for example, size exclusion chromatography and associated detectors. Additionally, the LWD module 386 may be provided with devices, such as sample chambers, for collecting fluid samples for retrieval at the surface. Backup pistons 390 may also be provided to assist in applying force to push the LWD module 386 and/or probe 388 against the borehole wall 394.

Figure 4:
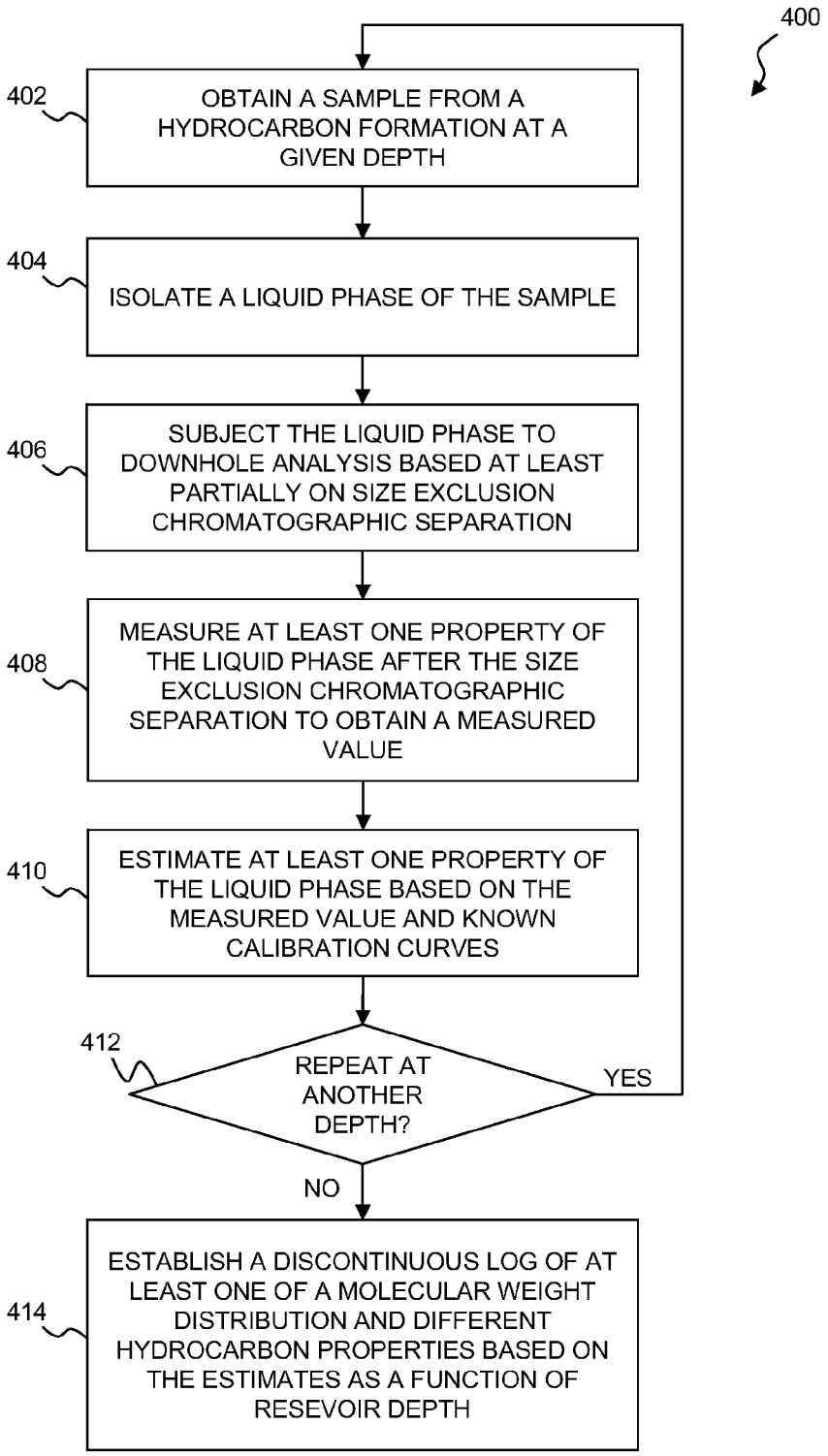
FIG. 4 is a flow chart of one embodiment of a method that includes performing downhole size exclusion chromatography.

Referring to FIG. 4, a method 400 illustrates one embodiment of a process that may be performed completely or partially using a downhole tool, such as the downhole tool 100 of FIGS. 1-3. The method 400 may be used to log different properties of downhole hydrocarbons as a function of the vertical or horizontal depth of the tool 100. It is understood that the method 400 may be performed using other tools and, in some embodiments, portions of the method 400 may be performed on the surface rather than within the tool 100.

In step 402, one or more hydrocarbon samples may be obtained at given depth of a reservoir. For example, the hydrocarbon sample may be obtained via the sampling probe 106 using heating and/or diluent injection. The process of obtaining such a hydrocarbon sample may occur using known downhole sampling tools and methods and so is not described in detail herein.

In step 404, the liquid phase (e.g., black oil) of the hydrocarbon sample may be isolated. This may be achieved using, for example, the separator 300 to separate the sample into portions such as a gas/condensate portion, a black oil portion, and a water portion. The liquid phase may then be mixed with solvent to achieve a desired consistency. In step 406, the liquid phase of the hydrocarbon sample is subjected to a downhole analysis based primarily on size exclusion chromatographic separation in a size exclusion chromatography module such as the GPC module 116. In step 408, various properties of the black oil/solvent mixture representing the hydrocarbon sample may be measured to obtain one or more measured values using one or more inflow detectors, such as the detectors 324 present in the detection module 206.

In step 410, various properties of the black oil may be estimated based on the measured values and known calibration curves, which may be universal and/or reservoir specific. Such properties include, but are not limited to, molecular weight distribution, API density, average molar mass, and asphaltene content. These estimations may be performed using the control module 208 or other logic contained within the tool 100.

It is understood that steps 402, 404, 406, 408, and 410 may be repeated at different depths to obtain a plurality of measurements and estimations. The number of depths at which the method 400 is repeated may vary based on such factors as the amount of information desired, the depth of the reservoir, the depth of the area of interest, and any other factors. Accordingly, a determination may be made in step 412 as to whether the steps should be repeated at a different depth. If yes, the tool 100 is moved and the method 400 returns to step 402. If not, the method 400 continues to step 414.

In step 414, a discontinuous log of the molar mass distribution and/or of the different hydrocarbon properties as a function of reservoir depth may be established based on the estimates. Step 414 may be performed using the control module 208 or other logic contained within the tool 100, or may be performed on the surface by other equipment. In some embodiments, some estimations may be performed by the tool 100 and others may be performed on the surface.

In other embodiments, at least portions of one or more of the hydrocarbon samples may be transported to the surface and subjected to the same analysis on stand alone equipment (i.e., rather than the equipment provided by the tool 100). The portions may also be subjected to other independent measurements to validate and re-calibrate the downhole measurements.

In still other embodiments, if needed, the properties for each of the hydrocarbon samples may be re-estimated based on the re-calibration for those samples analyzed both at the surface and downhole. Accordingly, a process of calibration and re-calibration may be used to correct for possible errors and to obtain a more accurate view of the hydrocarbon formation 104.

Figure 5:
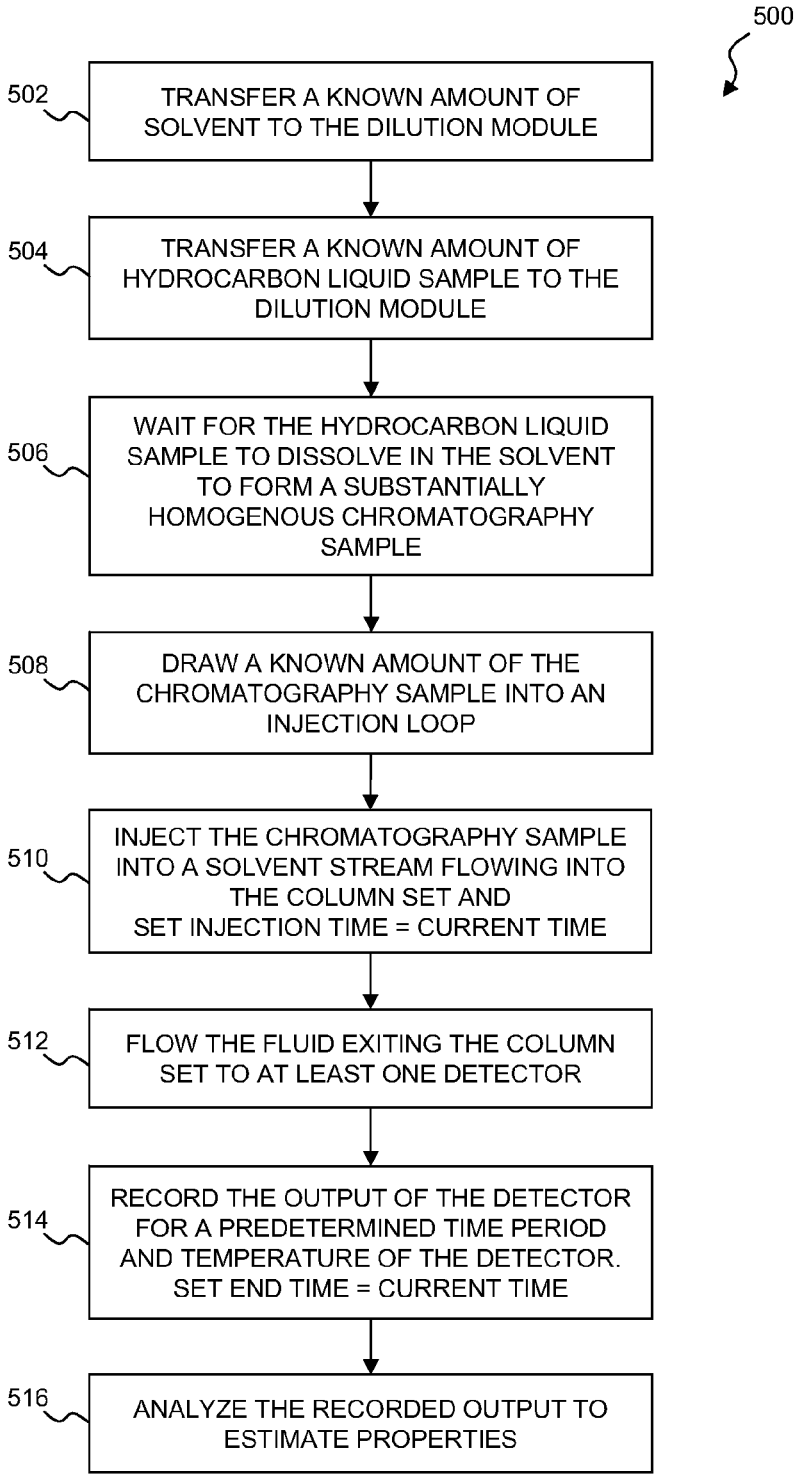
FIG. 5 is a flow chart of one embodiment of a method for analyzing hydrocarbon samples using downhole size exclusion chromatography.

Referring to FIG. 5, a method 500 illustrates one embodiment of a process that may be performed at least partly using a downhole tool, such as the downhole tool 100 of FIG. 3A. The method 500 may be used in conjunction with, or as part of, the method 400 of FIG. 4 to analyze hydrocarbon samples by means of downhole size exclusion chromatography. For example, portions of the method 500 may be used to perform steps 402, 404, and 406 of the method 400.

In step 502, a known amount of solvent is transferred via the valves 202 to the dilution/injection module 204, such as into the mixing chamber 308. In step 504, a known amount of a hydrocarbon liquid sample is transferred via the valves 202 to the dilution/injection module 204, such as into the mixing chamber 308. In some embodiments, an inline filter may be used to retain particles.

In step 506, the hydrocarbon liquid sample is allowed to dissolve into the solvent to form a homogenous solution in the mixing chamber 308. This dissolution process may be accomplished by waiting for a sufficient amount of time or may be accelerated by means of a convection driven mechanism such as mechanical stirring, ultrasound, recirculation with a pumping device, or by pure diffusion. Other mechanisms used for accelerating the dilution rate such as static mixers, moving parts, or temperature profiles may be used. Once the sample has dissolved completely, the solution is referred to herein as a "chromatography sample."

In step 508, a known amount of the chromatography sample may be drawn into the injection loop 316. In step 510, the chromatography sample is injected into a solvent stream flowing through the column set formed by columns 322 in the size exclusion separation module 116 (FIG. 2). It is noted that the solvent stream may be formed by a known controlled flow rate of solvent from the solvent reservoir 118 that is continuously flowed through the column set. The chromatography sample may be filtered when entering the injection loop 316 and/or before entering the column set by means of in-line filters. The column set is selected to provide a working size exclusion chromatographic separation. As this time, the current time is assigned as "injection time" (e.g., injection time=current time). In step 512, fluid exiting the column set is flowed into the detectors 324 of the detection module 206. This flow of fluid into the detectors 324 may be continuous.

In step 514, output signals produced by the detectors 324 are recorded. The recording may occur for a predetermined time period that may be defined as a time period long enough to ensure that all compounds present in the chromatography sample have completely eluted through the column set and the detectors 324. In other embodiments, the time period may be defined in other ways and may be dynamically determined based on, for example, the presence or absence of particles in the fluid exiting the column set. At this time, the current time is assigned as "end time" (e.g., end time=current time). The recorded output for each of the detectors between the "injection time" and the "end time" is saved as a "chromatogram." The chromatograms may be stored in the memory 330 of the control module 208 or elsewhere. During this time, the temperature of the detectors 324 may also be recorded and the temperature recording may be continuous.

In step 516, the recorded signals (e.g., the chromatograms) are analyzed by appropriate methods (examples of which are described below in greater detail) to estimate the desired oil properties. Although not shown, in some embodiments, a known sample (a narrow or broad standard which can be a polymer or an oil) may be injected as a calibration check prior to step 516. If needed, the calibration methods may be modified based on the calibration check.

Although not shown in FIG. 5, in some embodiments, a step may be inserted before step 510. In such a step, the chromatography sample may be checked by the pre-injection concentration estimation module 312 to determine whether it is ready for injection. If the chromatography sample is not ready for injection, its concentration may be altered to provide a higher quality analysis.

For example, the pre-injection concentration estimation module 312 may measure the UV absorption of the chromatography sample at a suitable wavelength to ensure that once injected into the column set, the detection signals will not saturate. If the UV absorption of the chromatography sample exceeds a predetermined maximum absorption value, a certain known amount of the chromatography sample contained in the dilution/injection module 204 may be disposed of and an equivalent amount of solvent may be transferred to the dilution module. If the UV absorption of the chromatography sample is below a predetermined minimum absorption value, a certain known amount of the chromatography sample contained in the dilution/injection module 204 is disposed of, and an equivalent amount of the chromatography sample may be transferred to the dilution module. This process may be repeated until the UV absorption of the chromatography sample is lower than the maximum absorption value and higher than the minimum absorption value.

Figure 6:
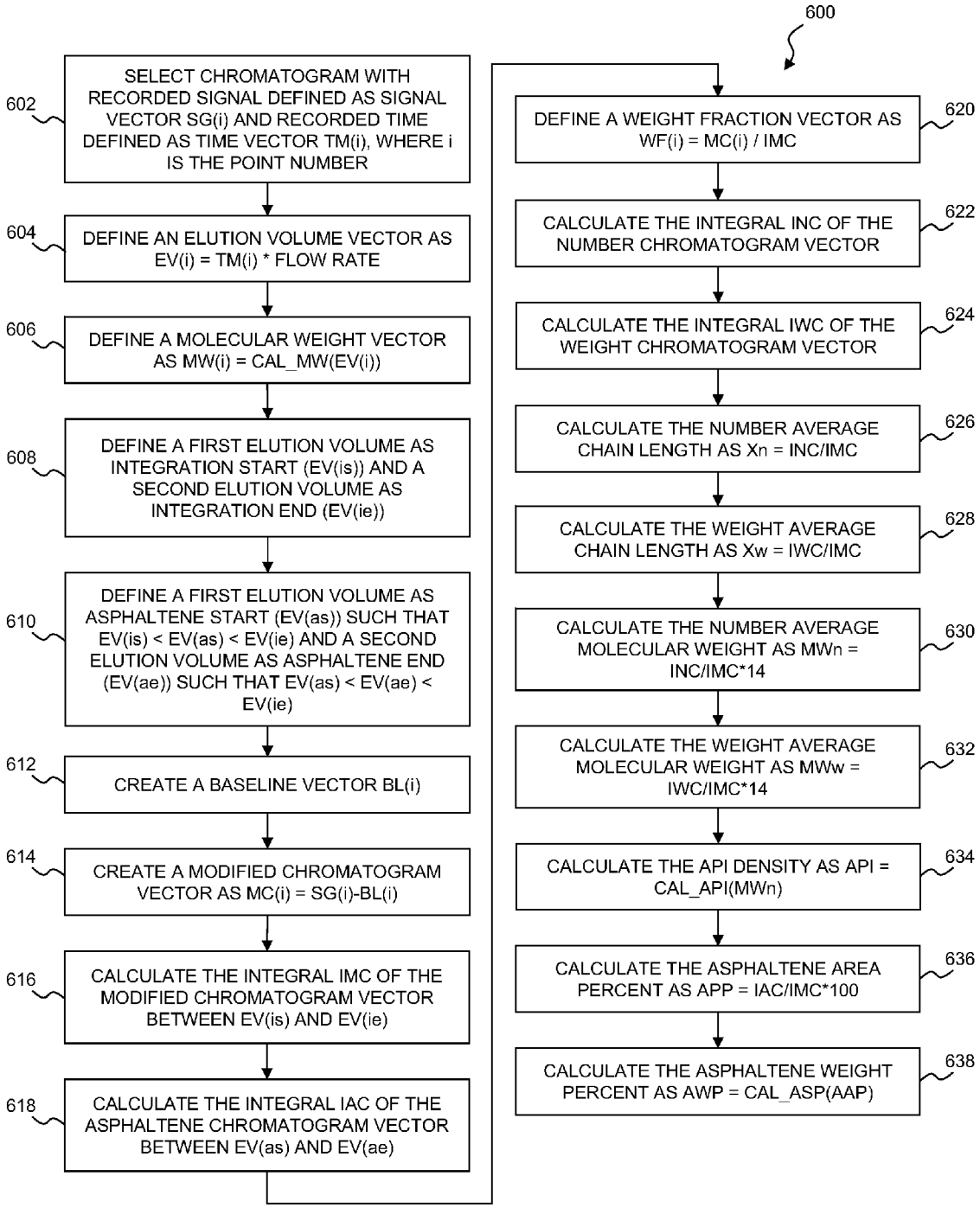
FIG. 6 is a flow chart of one embodiment of a method for a downhole determination of average molecular weight, API density, and asphaltene weight percent of an oil without the need of an internal standard using a mass detector capable of exhibiting a voltage response for each.

Referring to FIG. 6, a method 600 illustrates one embodiment of a process that may be used for a downhole determination of average molecular weight, API density, and asphaltene mass percent of an oil without the need of an internal standard using a mass detector capable of exhibiting a voltage response for each. Examples of such detectors include refractometers capable of measuring refractive index, spectrophotometers capable of measuring UV absorbance at wavelengths lower than 400 nm, and spectrophotometers capable of measuring UV fluorescence at wavelengths lower than 400 nm. It is understood that these are examples only and that other detectors 324 may be used in conjunction with or as alternatives to the provided examples. The method 600 may be used in conjunction with, or as part of, the method 500 of FIG. 5. For example, the method 600 may be used to perform step 516 of the method 500.

In step 602, a chromatogram is selected, such as may be produced in step 514 of FIG. 5. The recorded signal of the chromatogram may be considered as a "signal vector" SG(i), where i is the point number. The recorded time may be considered as a "time vector" TM(i), where i is the point number.

In step 604, an "elution volume vector" EV(i) may be defined as EV(i)=TM(i)*Flow Rate.

In step 606, a "molecular weight vector" MW(i) may be defined based on a calibration MW(i)=CAL_MW[EV(i)], where CAL_MW[EV(i)] is a mathematical function. An example of such a mathematical function is MW(i)=exp [AA+BB*EV(i)], where AA and BB are constants. The CAL_MW[EV(i)] function may be selected based on surface calibration with or without further modification based on a downhole calibration check with a calibration standard injection.

Although not shown in FIG. 6, in some embodiments, a Y-X plot may be created where the "signal vector" SG(i) is Y and "elution volume vector" EV(i) is X. In other embodiments, an X-Y plot may be created where the "signal vector" SG(i) is X and "elution volume vector" EV(i) is Y.

In step 608, a first elution volume is identified as "integration start" EV(is) and a second elution volume is identified as "integration end" EV(ie).

In step 610, a first elution volume is identified as "asphaltene start" EV(as), such that EV(is)<EV(as)<EV(ie). A second elution volume is identified as "asphaltene end" EV(ae), such that EV(as)<EV(ae)<EV(ie).

In step 612, a suitable "baseline vector" BL(i) is created. For example, one possible method of creating such a baseline vector is to define a straight line between the point [S(is),V(is)] and the point [S(ie),V(ie)].

In step 614, a "modified chromatogram vector" MC(i) is created as MC(i)=SG(i)−BL(i).

In step 616, the integral IMC of the "modified chromatogram vector" between the "integration start" EV(is) and the "integration end" EV(ie) is calculated as follows:

$$IMC = \int_{EV(is)}^{EV(ie)} MC(i)\,d\,EV(i)$$

In step 618, the integral IAC of the "asphaltene chromatogram vector" between the "asphaltene start" EV(as) and the "asphaltene end" EV(ae) is calculated as follows:

$$IAC = \int_{EV(as)}^{EV(ae)} MC(i)\,d\,EV(i)$$

In step 620, a "weight fraction vector" WF(i) is defined as WF(i)=MC(i)/IMC.

In step 622, the integral INC of the "number chromatogram vector" is calculated as follows:

$$INC = \int_{EV(as)}^{EV(ae)} MC(i)MW(i)\,dEV(i)$$

In step 624, the integral IWC of the "weight chromatogram vector" is calculated as follows:

$$IWC = \sum_{EV(as)}^{EV(ae)} MC(i)MW(i)^2\,dEV(i)$$

In step 626, the "Number Average Chain Length" Xn is calculated as Xn=INC/IMC.

In step 628, the "Weight Average Chain Length" Xw is calculated as Xw=IWC/IMC.

In step 630, the "Number Average Molecular Weight" MWn is calculated as MWn=INC/IMC*14.

In step 632, the "Weight Average Molecular Weight" MWw is calculated as MWw=IWC/IMC*14.

In step 634, the "API density" API is calculated as API=CAL_API(MWn), where CAL_API is a mathematical function. An example of such a mathematical function is API=CC+DD*MWn, where CC and DD are constants.

In step 636, the "Asphaltene Area percent" AAP is calculated as AAP=IAC/IMC*100.

In step 638, the "Asphaltene Weight percent" AWP is calculated as AWP=CAL_ASP(AAP), where CAL_ASP is a mathematical function. An example of such a mathematical function is AWP=EE+FF*AAP, where EE and FF are constants.

Figure 7:
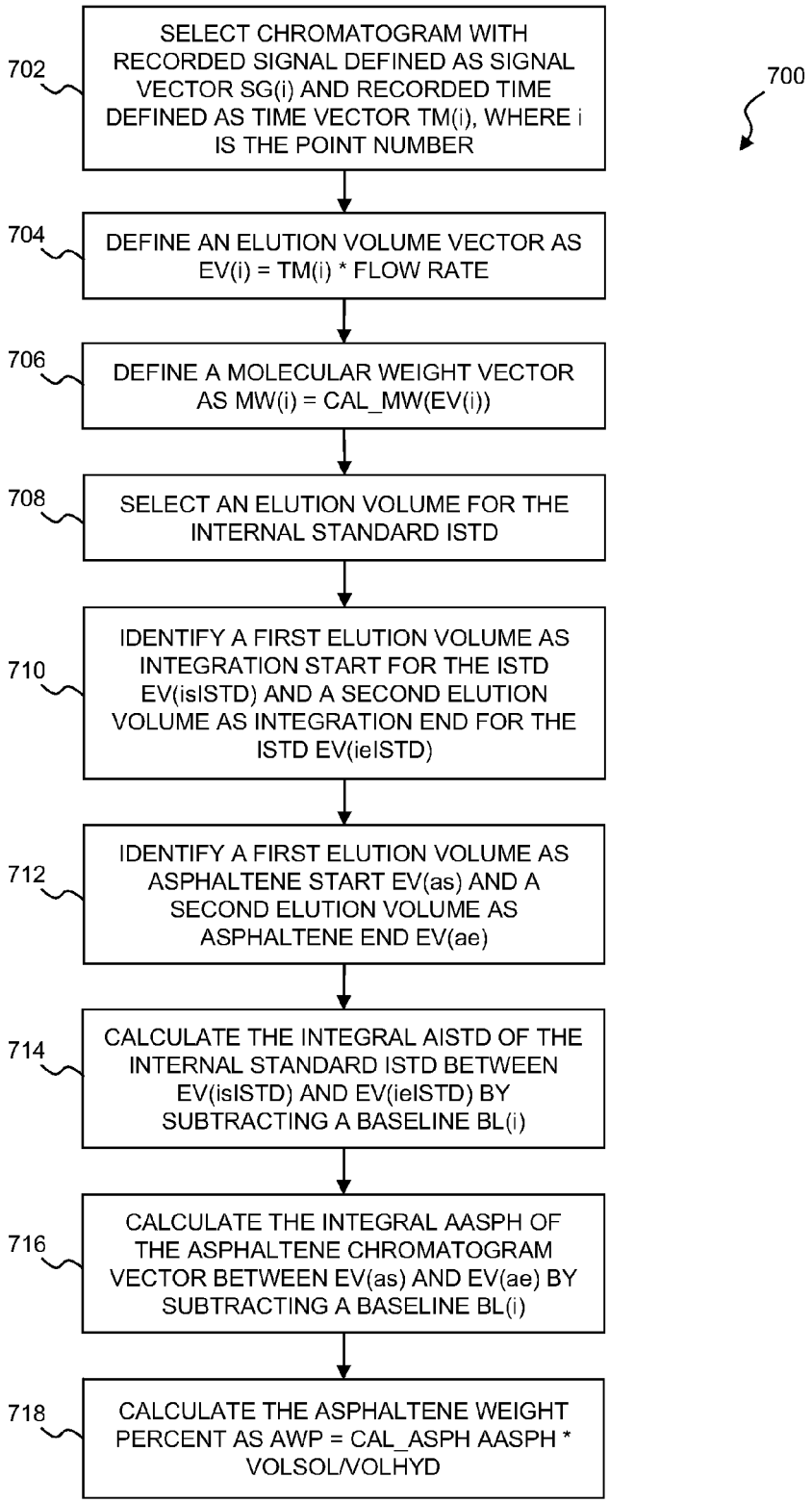
FIG. 7 is a flow chart of one embodiment of a method for a downhole determination of asphaltene weight percent of an oil by means of an internal standard calibration method using a mass detector capable of exhibiting a voltage response for each.

Referring to FIG. 7, a method 700 illustrates one embodiment of a process that may be used for a downhole determination of asphaltene weight percent of an oil by means of a internal standard calibration method using a mass detector capable of exhibiting a voltage response for each. Examples of such detectors include spectrophotometers capable of measuring UV absorbance at wavelengths higher than 400 nm, and more preferably around 600 nm, spectrophotometers capable of measuring UV fluorescence at wavelengths higher than 400 nm and more preferably around 600 nm, static light scattering detectors capable of measuring light scattering at angles between 5 and 175 degrees, more preferably 90 degrees, and any other suitable detector. It is understood that these are examples only and that other detectors 324 may be used in conjunction with or as alternatives to the provided examples. The method 700 may be used in conjunction with, or as part of, the method 500 of FIG. 5. For example, the method 700 may be used to perform step 516 of the method 500.

The internal standard is a compound with a significant voltage response at a retention time sufficiently different from those expected from the oil. In this example, a high molecular weight polymer such as polystyrene could be used as a standard. The internal standard is introduced into the eluent at a known amount. The amount of internal standard in the eluent can be monitored as a consistency check at the beginning or end of the process or in between samples by injecting an eluent sample and subjecting it to the same protocol test such as that described with respect to FIG. 5 and the accompanying text. For this procedure, the volume of the hydrocarbon sample VolHyd (as prepared in step 504 of FIG. 5) and solvent VolSol (as prepared in step 502 of FIG. 5) are needed.

In step 702, a chromatogram is selected, such as may be produced in step 514 of FIG. 5. The recorded signal of the chromatogram may be considered as a "signal vector" SG(i), where i is the point number. The recorded time may be considered as a "time vector" TM(i), where i is the point number.

In step 704, an "elution volume vector" EV(i) may be defined as EV(i)=TM(i)*Flow Rate.

In step 706, a "molecular weight vector" MW(i) may be defined based on a calibration MW(i)=CAL_MW(EV(i)), where CAL_MW(EV(i)) is a mathematical function. An example of such a mathematical function is MW(i)=exp [AA+BB*EV(i)], where AA and BB are constants. The CAL-MW(EV(i)) function may be selected based on surface calibration with or without further modification based on a downhole calibration check with a calibration standard injection.

Although not shown in FIG. 7, in some embodiments, a Y-X plot may be created where the "signal vector" SG(i) is Y and "elution volume vector" EV(i) is X. In other embodiments, an X-Y plot may be created where the "signal vector" SG(i) is X and "elution volume vector" EV(i) is Y.

In step 708, the elution volume may be selected for the internal standard ISTD.

In step 710, a first elution volume may be identified as "integration start for the ISTD" EV(isISTD) and a second elution volume may be identified as "integration end for the ISTD" EV(ieISTD).

In step 712, a first elution volume may be identified as "asphaltene start" EV(as) and a second elution volume may be identified as "asphaltene end" EV(ae).

In step 714, the integral AISTD of the "internal standard ISTD" between the "integration start for the ISTD" and the "integration end for the ISTD" may be calculated as follows by subtraction of a suitable base line BL(i):

$$AISTD = \int_{EV(isISTD)}^{EV(ieISTD)} [SG(i) - BL(i)]\,dEV(i)$$

In step 716, the integral AASPH of the "asphaltene chromatogram vector" between the "asphaltene start" and the "integration end" may be calculated by subtraction of a suitable base line BL(i):

$$AASPH = \int_{EV(as)}^{EV(ae)} [SG(i) - BL(i)]\,dEV(i)$$

In step 718, the "Asphaltene Weight Percent" AWP may be calculated as AWP=CAL_ASPH AASPH*VolSol/VolHyd, where CAL_ASPH is a mathematical function. An example of such a mathematical function is AWP=GG+HH*weightASP/VolSol, where GG and HH are constants.

It will be appreciated by those skilled in the art having the benefit of this disclosure that variations may be made to the described embodiments for the system and method for downhole size exclusion chromatography. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A method, comprising:

operating a downhole tool positioned in a borehole extending into a subterranean hydrocarbon reservoir, wherein the downhole tool comprises a separator, a reservoir, a solvent disposed in the reservoir, a mixing chamber, a size-exclusion chromatography module, a detector, and a control module, and wherein operating the downhole tool in the borehole comprises:

obtaining a sample from the reservoir;

separating a liquid oil portion from the sample using the separator;

mixing the liquid oil portion with the solvent in the mixing chamber to form a liquid oil/solvent mixture;

filtering the liquid oil/solvent mixture in the size exclusion chromatography module to remove hydrocarbon components having a molar mass less than about 0.350 kg/mol;

measuring the filtered liquid oil/solvent mixture using the detector to obtain a measured value; and estimating at least one property of the filtered liquid oil/solvent mixture using the control module and the measured value.

2. The method of claim 1 wherein the downhole tool further comprises a sampling probe, and wherein obtaining the sample from the reservoir uses the sampling probe.

3. The method of claim 1 wherein the detector comprises a spectrophotometer.

4. The method of claim 3 wherein the measured value is UV absorbance.

5. The method of claim 3 wherein the measured value is UV fluorescence.

6. The method of claim 1 wherein the at least one estimated property comprises asphaltene content.

7. The method of claim 1 wherein the at least one estimated property comprises molecular weight.

8. The method of claim 1 wherein the at least one estimated property comprises American Petroleum Institute (API) density.

9. The method of claim 1 wherein the at least one estimated property comprises average molar mass.

10. The method of claim 1 wherein estimating the at least one property using the control module and the measured value comprises estimating the at least one property using the control module, the measured value, and a predetermined calibration curve.

11. The method of claim 10 wherein the predetermined calibration curve is associated specifically with the reservoir.

12. The method of claim 10 wherein the predetermined calibration curve is not specifically associated with the reservoir.

13. The method of claim 1 wherein:

obtaining the sample from the reservoir comprises obtaining the sample at a depth within the borehole;

operating the downhole tool in the borehole further comprises obtaining a plurality of additional samples from the reservoir at corresponding ones of a plurality of additional depths within the borehole and, for each of the plurality of additional samples:

separating a liquid oil portion from the sample using the separator;

mixing the liquid oil portion with the solvent in the mixing chamber to form a liquid oil/solvent mixture;

filtering the liquid oil/solvent mixture in the size exclusion chromatography module to remove hydrocarbon components having a molar mass less than about 0.350 kg/mol;

measuring the filtered liquid oil/solvent mixture using the detector to obtain a measured value; and estimating at least one property of the filtered liquid oil/solvent mixture using the control module and the measured value; and operating the downhole tool in the borehole further comprises establishing a discontinuous log of the at least one property estimated for the sample and each of the plurality of additional samples.

14. The method of claim 13 wherein the at least one property estimated for the sample and each of the plurality of additional samples comprises asphaltene content, and wherein the discontinuous log relates asphaltene content distribution within the reservoir.

15. The method of claim 13 wherein the at least one property estimated for the sample and each of the plurality of additional samples comprises molecular weight, and wherein the discontinuous log relates molecular weight distribution, within the reservoir, of liquid oil components having a molar mass not less than about 0.350 kg/mol.

16. The method of claim 13 wherein the at least one property estimated for the sample and each of the plurality of additional samples comprises American Petroleum Institute (API) density, and wherein the discontinuous log relates API density distribution, within the reservoir, of liquid oil components having a molar mass not less than about 0.350 kg/mol.

17. The method of claim 13 wherein the at least one property estimated for the sample and each of the plurality of additional samples comprises molar mass, and wherein the discontinuous log relates molar mass distribution, within the reservoir, of liquid oil components having a molar mass not less than about 0.350 kg/mol.

18. The method of claim 1 further comprising:

transporting out of the borehole, to a surface location, a portion of at least one of:

the sample obtained from the reservoir; and the filtered liquid oil/solvent mixture;

testing the transported portion to obtain a surface measurement value;

comparing the surface measurement value with the measured value to obtain a comparison value; and calibrating the downhole tool using the comparison value.

19. The method of claim 1 wherein the downhole tool further comprises a degasification unit, and wherein operating the downhole tool in the borehole further comprises degasifying the solvent using the degasification unit before mixing with the liquid oil portion.

20. The method of claim 1 wherein:

the downhole tool further comprises a sampling probe;

obtaining the sample from the reservoir uses the sampling probe;

the detector comprises a spectrophotometer;

the measured value is at least one of UV absorbance and UV fluorescence;

estimating the at least one property using the control module and the measured value comprises estimating the at least one property using the control module, the measured value, and a predetermined calibration curve;

the predetermined calibration curve is specifically associated with the reservoir;

obtaining the sample from the reservoir comprises obtaining the sample at a depth within the borehole;

operating the downhole tool in the borehole further comprises obtaining a plurality of additional samples from the reservoir at corresponding ones of a plurality of additional depths within the borehole and, for each of the plurality of additional samples:

separating a liquid oil portion from the sample using the separator;

mixing the liquid oil portion with the solvent in the mixing chamber to form a liquid oil/solvent mixture;

filtering the liquid oil/solvent mixture in the size exclusion chromatography module to remove hydrocarbon components having a molar mass less than about 0.350 kg/mol;

measuring the filtered liquid oil/solvent mixture using the detector to obtain a measured value; and estimating at least one property of the filtered liquid oil/solvent mixture using the control module and the measured value;

operating the downhole tool in the borehole further comprises establishing a discontinuous log of the at least one property estimated for the sample and each of the plurality of additional samples;

the at least one property estimated for the sample and each of the plurality of additional samples comprises a plurality of properties comprising asphaltene content, molecular weight, American Petroleum Institute (API) density, and molar mass;

the discontinuous log relates distribution of each of the plurality of properties, within the reservoir, of liquid oil components having a molar mass not less than about 0.350 kg/mol;

the downhole tool further comprises a degasification unit;

operating the downhole tool in the borehole further comprises degasifying the solvent using the degasification unit before mixing with the liquid oil portion; and the method further comprises:

transporting to the surface a portion of at least one of:

the sample obtained from the reservoir; and the filtered liquid oil/solvent mixture;

testing the transported portion to obtain a surface measurement value;

comparing the surface measurement value with the measured value to obtain a comparison value; and re-calibrating the downhole tool using the comparison value.

* * * * *